US005730639A

United States Patent [19]

Harding

[11] Patent Number: 5,730,639

[45] Date of Patent: Mar. 24, 1998

[54] WHEEL AND CONTROL STICK TOY

[76] Inventor: Jasper E. Harding, 5633 Apt. 123 Paces Glen Ave., Charlotte, N.C. 28212

[21] Appl. No.: 707,950

[22] Filed: Sep. 10, 1996

[51] Int. Cl.[6] ..... A63H 33/02

[52] U.S. Cl. ..... 446/453; 446/450

[58] Field of Search ..... 446/431, 450, 446/451, 452, 453; D21/101, 210

[56] References Cited

U.S. PATENT DOCUMENTS

| | | | |
|---|---|---|---|
| 1,499,216 | 6/1924 | Hart | 446/450 |
| 1,909,718 | 5/1933 | Portteus | 446/450 |
| 2,748,533 | 6/1956 | Cipolla | 446/453 |
| 2,976,645 | 3/1961 | Hight et al. | 446/450 |
| 2,985,985 | 5/1961 | Brooy et al. | 446/450 |
| 3,696,556 | 10/1972 | Plasket . | |
| 3,715,834 | 2/1973 | Gelis | 46/220 |
| 3,788,000 | 1/1974 | Jenkins | 46/205 |
| 3,823,507 | 7/1974 | Berner | 46/220 |
| 3,956,851 | 5/1976 | Tapinekis | 46/220 |
| 4,091,564 | 5/1978 | Jasinski | 46/220 |
| 4,148,153 | 4/1979 | Phillips, Jr. | 446/450 |
| 4,188,749 | 2/1980 | Oliver | 46/220 |
| 4,616,830 | 10/1986 | Moore | 446/450 |
| 4,799,917 | 1/1989 | Lentz | 446/450 |
| 4,897,069 | 1/1990 | Overturf | 446/450 |

*Primary Examiner*—Michael A. Brown
*Assistant Examiner*—Jeffrey D. Carlson
*Attorney, Agent, or Firm*—Dougherty & Dremann

[57] ABSTRACT

A wheel and control stick toy includes a wheel defining a transverse axis and a control stick for manipulating the wheel on a horizontal surface. The wheel includes a centrally disposed, transverse axle which is coaxial with the transverse axis of the wheel. The wheel further includes a peripherally disposed, transversely extending flange and a side wall extending between and connecting the axle and the flange. The exterior surface of the wheel preferably has a convex curvature so that the wheel can be tilted up to an angle of at least about 45 degrees from vertical. The axle of the wheel is preferably hollow and defines an opening extending through the wheel. The control stick includes an elongate rod having opposed ends. A handle portion is provided adjacent one of the opposed ends, and a stem portion is fixed to the other opposed end of the rod. The stem portion comprises a pair of opposed, inwardly extending fingers which define an opening therebetween for receiving the wheel therein. Preferably, the stem portion is C-shaped and further includes an arcuate portion extending between and connecting the fingers. The axle, side wall, flange and exterior surface of the wheel provide a variety of control surfaces to be engaged by the control stick so that the wheel can be manipulated using the control stick in a multitude of ways. Accordingly, both children and adults are challenged to devise original methods of manipulating the wheel using the control stick, and are unlikely to become disinterested with the toy.

2 Claims, 3 Drawing Sheets

WHEEL AND CONTROL STICK TOY

FIELD OF THE INVENTION

The invention relates generally to toys. More particularly, the invention relates to a toy consisting of a wheel and a control stick for manipulating the wheel.

BACKGROUND OF THE INVENTION

One of the oldest known toys for the amusement of both children and adults consists of a wheel, or hoop, and a control stick for driving and manipulating the wheel or hoop on a horizontal surface. Many improvements have been proposed for increasing the number and type of movements which can be accomplished by the user, and for increasing the level of skill required by the user to manipulate the wheel with the control stick. Examples of known hoop and control stick toys are disclosed in U.S. Pat. No. 3,696,556 to Plasket, U.S. Pat. No. 3,715,834 to Gelis, U.S. Pat. No. 3,788,000 to Jenkins, U.S. Pat. No. 3,823,507 to Berner, and U.S. Pat. No. 3,956,851 to Tapinekis. The options available to the user for driving and manipulating the hoop using the control stick, however, are limited with these toys. Thus, once the user has mastered the minimal level of skill required to drive and manipulate the hoop with the control stick, the user becomes disinterested in the toy.

Improvements to wheel and control stick toys have also been proposed. The most notable examples are the wheel and control stick toys disclosed in U.S. Pat. No. 4,091,564 to Jasinski, and U.S. Pat. No. 4,188,749 to Oliver. The Jasinski toy includes a thin, disc-shaped wheel and a control stick terminating in a head at one end for driving and manipulating the disc. The head of the control stick includes a pair of spaced apart flanges for engaging the side walls of the wheel, and a semi-circular surface disposed between the parallel flanges for engaging the periphery of the wheel. By moving the control stick forward and sideways, the user can push the wheel, turn the wheel, and tilt the wheel up to an angle of about 45 degrees from vertical without losing control of the wheel.

The Oliver toy includes a wheel formed from a pair of thin flat discs having central openings sandwiching a ring made of a foam-like material and a control stick for manipulating the wheel on a horizontal surface. The foam material is provided with a metal rim which extends radially outwardly from the periphery of the discs so that the wheel makes a noise as it rolls on the horizontal surface. The control stick includes a handle portion and a stem portion terminating in a semi-circular hook which cradles the metal rim and engages one of the outer, peripheral edges of the discs so that the wheel may be driven along the ground by engagement with the control stick. The hook provided on the stem portion of the control stick may be positioned through the central openings provided in the foam-material and the discs to capture the wheel should the user lose control of the wheel. Similarly, the options for engaging the wheel with the control stick are limited, and thus the user becomes disinterested with the toy once the minimal level of skill required to manipulate the wheel with the control stick is achieved.

It is thus apparent that a wheel and control stick toy is needed which provides additional options for manipulating the wheel with the control stick as the level of skill of the user increases, thereby maintaining the interest of the user. Such a wheel and stick control toy would provide amusement, while simultaneously improving the cognitive and dexterity skills of both children and adults who would be encouraged to devise original ways to manipulate the wheel with the control stick.

OBJECTS OF THE INVENTION

Accordingly, it is an object of the invention to provide a wheel and control stick toy which maintains the interest of both children and adults.

It is another, and more particular, object of the invention to provide a wheel and control stick toy which features an increased number of options for manipulating the wheel with the control stick.

It is another object of the invention to provide a wheel and control stick toy which includes a pair of opposed fingers with which the user can engage a variety of control surfaces on the wheel to manipulate the wheel with the control stick.

It is another object of the invention to provide a wheel and control stick toy which includes a wheel having a variety of contact surfaces to be engaged by the control stick to increase the number and complexity of wheel movements which can be accomplished by the user.

It is another object of the invention to provide a wheel and control stick toy which provides amusement, while simultaneously improving the cognitive and dexterity skills of both children and adults.

It is another object of the invention to provide a wheel and control stick toy which challenges both children and adults to devise original ways of manipulating the wheel with the control stick.

SUMMARY OF THE INVENTION

The invention is a toy for the amusement of both children and adults. Preferably, the toy consists of a wheel and a control stick for manipulating the wheel on a horizontal surface. The toy includes a cylindrical wheel which defines a transverse axis. The wheel includes a centrally disposed, transverse axle which is coaxial with the transverse axis of the wheel. The wheel further includes a peripherally disposed, transversely extending flange, and a side wall extending between and connecting the axle and the flange.

The exterior surface of the wheel preferably has a convex curvature. The exterior surface of the axle, the side wall and the interior surface of the flange of the wheel define a recess. In a preferred embodiment, the axle of the wheel is hollow and defines a transverse opening which extends through the wheel.

The control stick includes a rod having opposed ends. The rod includes a handle portion adjacent one of the opposed ends, and a stem portion fixed to the other of the opposed ends. The stem portion includes a pair of opposed, inwardly extending fingers which define an opening therebetween. Preferably, the stem portion is C-shaped and includes an arcuate portion extending between and connecting the pair of opposed fingers. The opening defined by the opposed fingers of the stem portion of the control stick is sized to receive the transversely extending flange of the wheel therein.

The structural configuration of the wheel and the control stick permit the user to manipulate the wheel using the control stick in a variety of ways. For example, the user can position at least one of the pair of opposed fingers of the stem portion of the control stick within the recess defined by the axle, the side wall and the flange of the wheel. The wheel can then be manipulated using the control stick by contacting the exterior surface of the axle, the side wall, or the interior surface of the flange with the at least one finger of the stem portion of the control stick. The other of the opposed fingers of the stem portion of the control stick is preferably positioned against the exterior surface of the wheel to keep the wheel upright.

As the level of skill of the user increases, the other of the opposed fingers may be positioned in the recess defined by the axle, the side wall and the flange on the opposite side of the wheel. The wheel can then be manipulated and kept upright by alternating the opposed finger which contacts the exterior surface of the axle, the side wall, or the interior surface of the flange, as applicable. Further, the other of the opposed fingers may be removed from the exterior surface of the wheel so that the user must keep the wheel upright using only one of the opposed fingers of the stem portion of the control stick, or may be held against the exterior surface of the wheel so that the wheel rotates in a tilted orientation of at least about 45 degrees from vertical.

Alternatively, the user can manipulate the wheel using the control stick by cradling the axle of the wheel within the arcuate portion of the stem portion of the control stick adjacent one of the opposed fingers so that the inner surface of the stem portion engages the exterior surface of the axle of the wheel. The other of the opposed fingers of the stem portion of the control stick is preferably positioned against the exterior surface of the wheel to keep the wheel upright. As the level of skill of the user increases, the other of the opposed fingers may be removed from the exterior surface of the wheel so that the user must keep the wheel upright using only one of the opposed fingers of the stem portion of the control stick, or may be held against the exterior surface of the wheel so that the wheel rotates in a tilted orientation of at least about 45 degrees from vertical.

In an alternative embodiment, the opposed fingers of the stem portion of the control stick include a necked-down portion adjacent the inwardly extending end of the finger, and the arcuate portion extending between and connecting the fingers is lengthened so that the opening defined by the fingers is wider than necessary to receive the wheel therein. One of the opposed fingers of the stem portion of the control stick is positioned within the opening defined by the hollow axle of the wheel. The other of the opposed fingers of the stem portion of the control stick may be positioned against the exterior surface of the wheel, or may be positioned within the recess defined by the axle, the side wall, and the flange of the wheel on the opposite side of the wheel.

As is now apparent, the wheel and control stick toy of the invention maintains the interest of both children and adults. More particularly, the invention provides a wheel and control stick toy which features an increased number of options for manipulating the wheel using the control stick. Specifically, the invention provides a wheel and control stick toy which includes a wheel having a variety of contact surfaces to be engaged by the control stick so that the number and complexity of wheel movements which can be accomplished by the user is increased. Accordingly, the wheel and control stick toy of the invention provides amusement, while simultaneously improving the cognitive and dexterity skills of both children and adults by challenging the user to devise original ways of manipulating the wheel with the control stick. Thus, the user is unlikely to become disinterested in the toy.

BRIEF DESCRIPTION OF THE DRAWINGS

While some of the objects and advantages of the invention have been stated, others will become apparent as preferred embodiments of the invention are described in connection with the accompanying drawings in which.

DETAILED DESCRIPTION OF THE PREFERRED EMBODIMENTS

Figure 1:
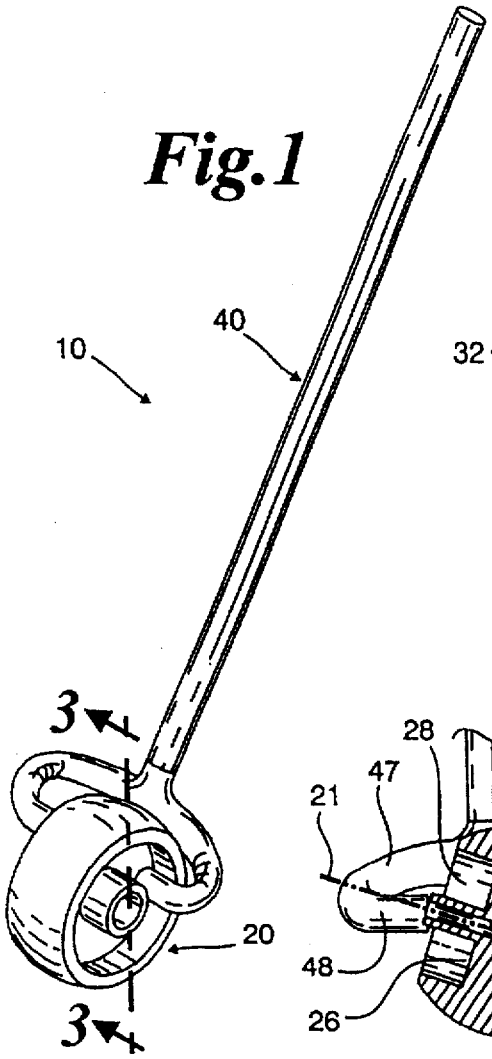
FIG. 1 is a perspective view of a wheel and control stick toy according to the invention.

Referring now to the accompanying drawings, in which like reference numerals indicate like parts, FIG. 1 is a perspective view of a wheel and control stick toy, indicated generally at 10, according to the invention. The wheel and control stick toy 10 provides additional options for manipulating the wheel with the control stick. The wheel and control stick toy 10 includes a wheel 20 having a variety of contact surfaces to be engaged by the control stick 40 so that the number and complexity of wheel movements which can be accomplished by the user is increased. Accordingly, the wheel and control stick toy 10 provides amusement, while simultaneously improving the cognitive and dexterity skills of both children and adults by challenging the user to devise original ways of manipulating the wheel 20 with the control stick 40. Thus, the user is unlikely to become disinterested in the wheel and control stick toy 10.

Figure 2:
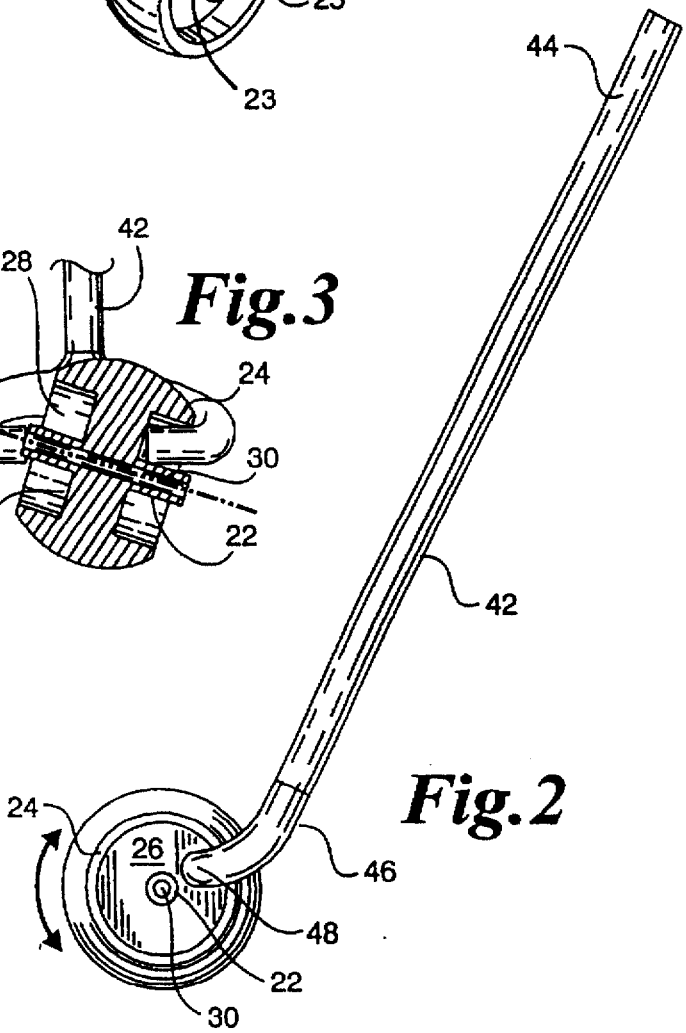
FIG. 2 is a side elevational view of the wheel and control stick toy of FIG. 1.

Wheel 20 is preferably molded from a rigid material, such as hard plastic. As best shown in side elevational view FIG. 2 and partial sectional view FIG. 3, wheel 20 defines a transverse axis 21 and comprises a centrally disposed, transverse axle 22 which is co-axial with the transverse axis of the wheel. The wheel 20 further comprises a peripherally disposed, transversely extending flange 24 and a side wall 26 which extends between and connects the axle 22 and the flange. The exterior surface of the axle 22, the side wall 26 and the interior surface of the flange 24 define an inwardly extending recess 28 in the side of the wheel 20. Preferably, the wheel 20 is symmetric about an axis which is perpendicular to the transverse axis 21. Thus, each side of the wheel comprises a transversely extending axle 22, a side wall 26, a transversely extending flange 24 and a recess 28 defined by the axle 22, the side wall 26 and the flange 24.

Axle 22 is preferably hollow and defines a transverse opening 30 therein. The exterior surface 32 of the wheel 20 preferably has a convex curvature so that the wheel is easily unbalanced and must be kept upright while manipulating the wheel with the control stick. Thus, an increased the level of skill is required to manipulate the wheel 20 using the control stick 40 without losing control of the wheel.

The control stick 40 comprises an elongate rod 42 having a pair of opposed ends. The rod 42 is preferably hollow and made of a lightweight material, such as aluminum or plastic. The rod 42 comprises a handle portion 44 adjacent one of the opposed ends, and a stem portion 46 which is fixed to the other of the opposed ends. Stem portion 46 comprises a pair of opposed, inwardly extending fingers 48 which define an opening therebetween sized for receiving the transversely extending flange 24 of the wheel 20 therein. The opening defined by the fingers 48 receives the flange 24 therein so that the stem portion 46 of the control stick 40 removably engages wheel 20 to manipulate the wheel on a horizontal surface.

Preferably, the opposed fingers 48 extend inwardly on a line which is perpendicular to the longitudinal axis of the rod 42. However, fingers 48 may extend on a line which is at any predetermined angle relative to the longitudinal axis of the rod 42, or may be angularly offset relative to each other and the longitudinal axis of the rod. The stem portion 46 preferably is C-shaped and comprises an arcuate portion 47 (FIG. 3) extending between and connecting the opposed fingers 48. The arcuate portion 47 preferably has a concave curvature which conforms generally to the convex curvature of the exterior surface 32 of the wheel 20 for a purpose to be described hereafter.

Figure 4:
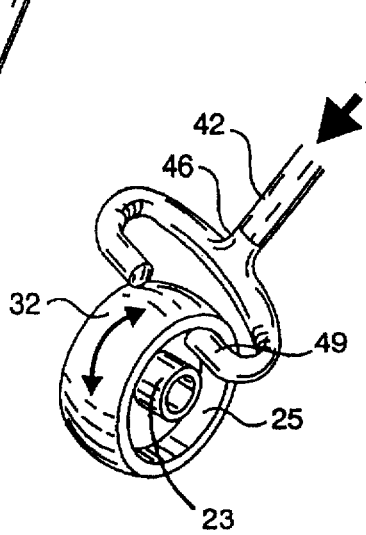
FIG. 4 is a perspective view of a preferred method of manipulating a wheel and control stick toy according to the invention.

The structural configuration of the wheel 20 and the control stick 40 permit the user to manipulate the wheel using the control stick in a multitude of ways. Specifically, the wheel 20 comprises a variety of contact surfaces to be engaged by the stem portion 46 of the control stick 40. For example, as illustrated in FIG. 4, the user can position at least one of the pair of opposed fingers 48 of the stem portion 46 of the control stick 40 within the recess 28 defined by the axle 22, the side wall 26 and the flange 24 of the wheel 20. The wheel 20 can then be manipulated using the control stick 40 by contacting the exterior surface 23 of the axle 22, the side wall 26, or the interior surface 25 of the flange 24 (as shown) with the exterior surface 49 of the at least one finger 48 of the stem portion 46 of the control stick. The other of the opposed fingers 48 of the stem portion 46 of the control stick 40 is preferably positioned against the exterior surface 32 of the wheel to keep the wheel 20 upright.

The wheel 20 can be caused to rotate about the transverse axis 21 in the directions indicated by the solid arrow in FIG. 4 by moving the control stick 40 forward and backward as indicated by the broken arrow. If the user pulls backward on the control stick 40 (as shown), the exterior surface 49 of the at least one opposed finger 48 of the stem portion 46 engages the interior surface 25 of flange 24 and the wheel 20 rotates in the direction of the control stick. If the user pushes forward, and slightly upwards, on the control stick 40, the wheel 20 rotates in the direction away from the control stick.

Figure 3:
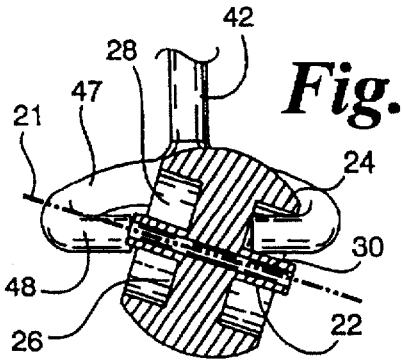
FIG. 3 is a partial sectional view of the wheel and control stick toy of FIG. 1 taken along the line 3—3.

The user can also position the exterior surface 49 of the at least one finger 48 of the stem portion 46 of the control stick 40 against the side wall 26 or the exterior surface 23 of the axle 22 to rotate the wheel 20. As the level of skill of the user increases, the other of the opposed fingers 48 may be positioned in the recess 28 defined by the axle 22, the side wall 26 and the flange 24 on the opposite side of the wheel 20. The wheel 20 can then be manipulated and kept upright by alternating the opposed finger 28 which contacts the exterior surface 23 of the axle 22, the side wall 26, or the interior surface 25 of the flange 24, as applicable. Further, the other of the opposed fingers 48 of the stem portion 46 of the control stick 40 may periodically be removed from against the exterior surface 32 of the wheel 20 so that the user must keep the wheel upright using only one of the opposed fingers of the stem portion of the control stick, or may be held against the exterior surface of the wheel so that the wheel rotates in a tilted orientation of at least about 45 degrees from vertical (FIG. 3).

Figure 5:
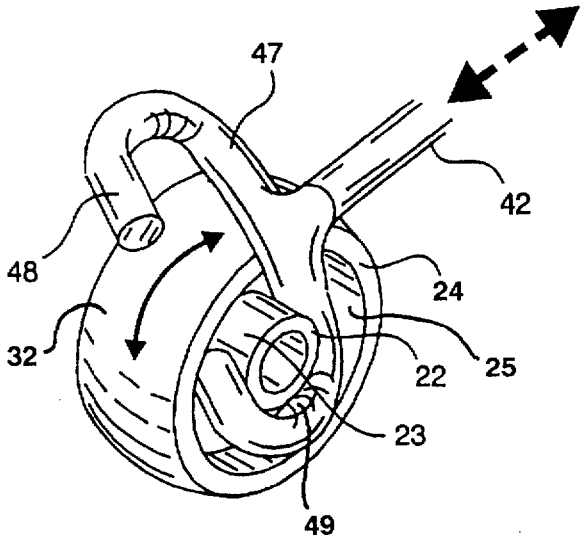
FIG. 5 is a perspective view illustrating another preferred method of manipulating a wheel and control stick toy according to the invention.
Figure 6:
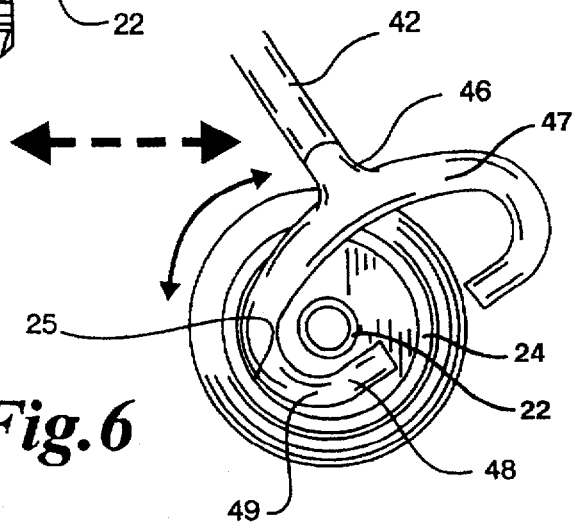
FIG. 6 is a side elevational view illustrating the preferred method of FIG. 5 of manipulating a wheel and control stick toy according to the invention.

Another preferred method of manipulating the wheel 20 using the control stick 40 is illustrated in FIGS. 5 and 6. The user can manipulate the wheel 20 using the control stick 40 by cradling the axle 22 of the wheel within the arcuate portion 47 of the stem portion 46 of the control stick adjacent one of the opposed fingers 48 so that the exterior surface 49 of the arcuate portion and the finger engages the exterior surface 23 of the axle 22 of the wheel 20. The other of the opposed fingers 48 of the stem portion 46 of the control stick 40 is preferably positioned against the exterior surface 32 of the wheel 20 to keep the wheel upright.

The wheel 20 can be caused to rotate about the transverse axis 21 in the directions indicated by the solid arrows in FIGS. 5 and 6 by moving the control stick 40 forward and backward as indicated by the broken arrows. If the user pulls backward on the control stick 40 (FIG. 6), the exterior surface 49 of the arcuate portion 47 and the finger 48 of the stem portion 46 engages the interior surface 25 of flange 24 and the wheel 20 rotates in the direction of the control stick. If the user pushes forward on the control stick 40 (FIG. 5), the exterior surface 49 of the arcuate portion 47 and the finger 48 of the stem portion 46 engages the exterior surface 23 of axle 22 and the wheel 20 rotates in the direction away from the control stick.

As the level of skill of the user increases, the other of the opposed fingers 48 of the stem portion 46 of the control stick 40 may periodically be removed from the exterior surface 32 of the wheel 20 so that the user must keep the wheel upright using only one of the opposed fingers of the stem portion of the control stick, or may be held against the exterior surface of the wheel so that the wheel rotates in a tilted orientation of at least about 45 degrees from vertical.

Figure 7:
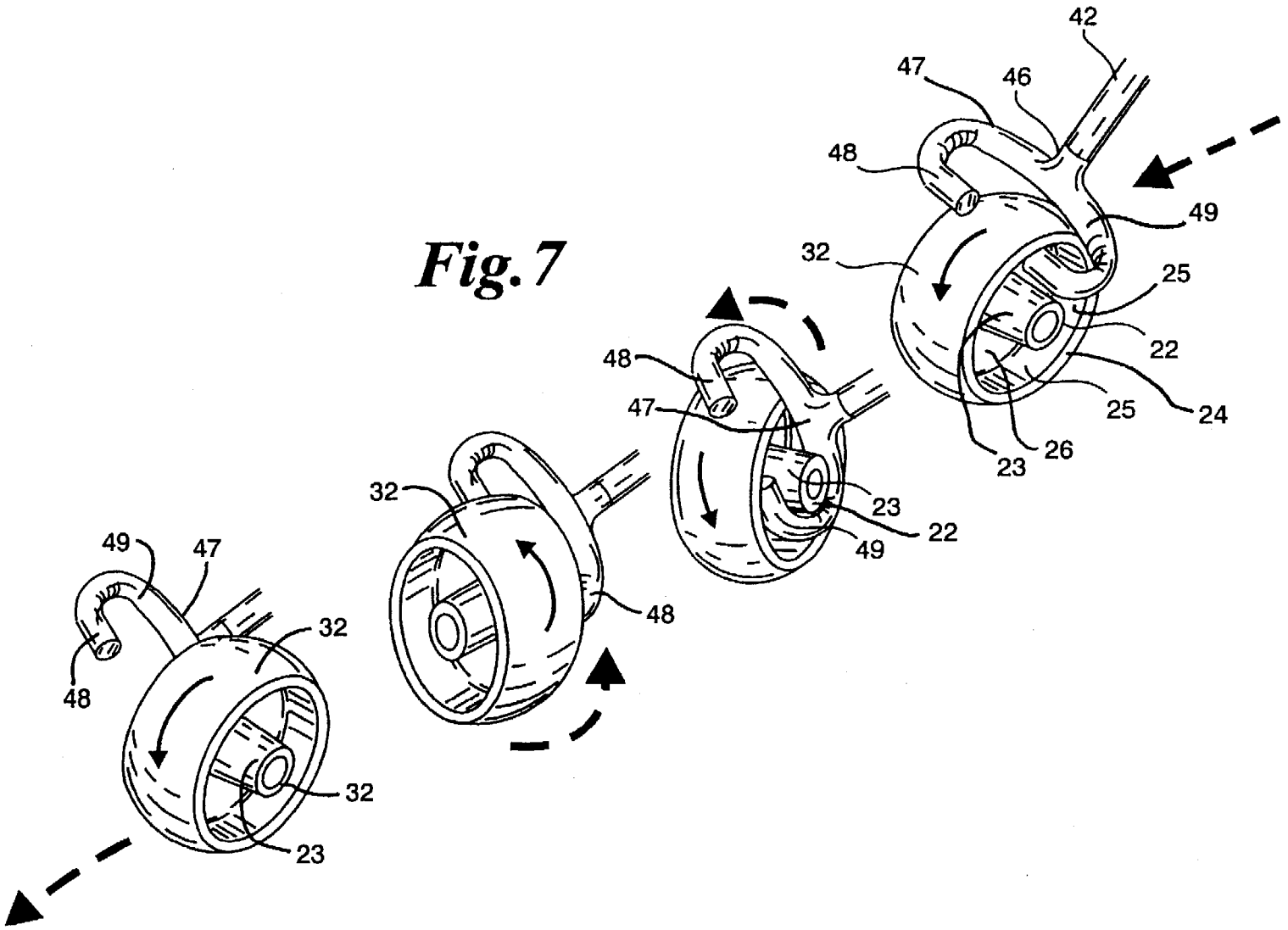
FIG. 7 is a series of perspective views illustrating another preferred method of manipulating a wheel and control stick toy according to the invention.

Another preferred method of manipulating the wheel 20 using the control stick 40 is illustrated in the series of perspective views of FIG. 7. By moving the control stick 40 in the directions indicated by the broken arrows in FIG. 7, the user can cause the wheel 20 to rotate 180 degrees about an axis perpendicular to the transverse axis 21 and passing through the point of contact of the exterior surface 32 of the wheel with the horizontal surface while rotating about the transverse axis in the directions indicated by the solid arrows. Similar to the position illustrated in FIG. 4 one of the opposed fingers 48 of the stem portion 46 of the control stick 40 is placed within the recess 28 defined by the axle 22 the side wall 26 and the flange 24 of the wheel 20. The other of the opposed fingers 48 is positioned against the exterior surface 32 of the wheel 20.

The user pushes forward on the control stick 40 with the one finger 48 of the stem portion 46 of the control stick 40 engaging the exterior surface 23 of the axle 22, the side wall 26 or the interior surface 25 of the flange 24 of the wheel 20, and the exterior surface 49 of the arcuate portion 47 of the stem portion engaging the exterior surface 32 of the wheel, so that the wheel rotates in the direction away from the control stick. While continuing to push the control stick 40 forward, the user turns the control stick so that the one opposed finger 48 cradles the axle 22 of the wheel 20 and the exterior surface 49 of the arcuate portion 47 and the one finger engages the exterior surface 23 of the axle 22, similar to the position illustrated in FIG. 5.

Because the exterior surface 32 of the wheel 20 has a convex curvature, the wheel begins to rotate about an axis perpendicular to the transverse axis 21 and passing through the point of contact of the exterior surface of the wheel with the horizontal surface while simultaneously rotating about the transverse axis. Whilecontinuing to turn the control stick 40, the user pulls backward slightly on the control stick so that the wheel rotates 180 degrees about the axis perpendicular to the transverse axis 21 and passing the through the point of contact of the exterior surface 32 of the wheel 20 with the horizontal surface. Once the wheel 20 has rotated 180 degrees, the one opposed finger 28 cradles the axle 22 of the wheel and the exterior surface 49 of the arcuate portion 47 and the one finger engages the exterior surface 23 of the axle 22, similar to the position illustrated in FIG. 6.

Figure 8:
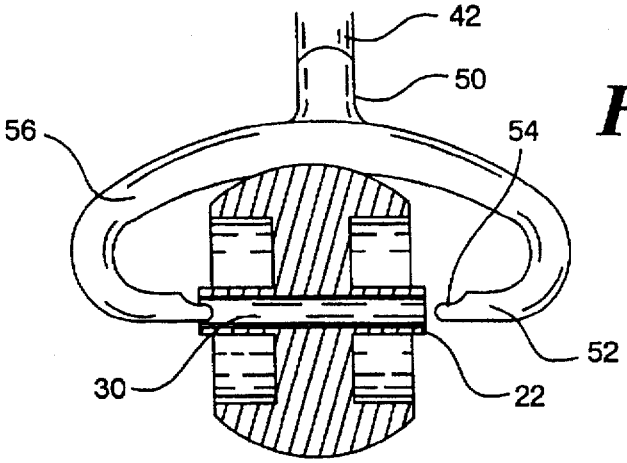
FIG. 8 is a partial sectional view of an alternative embodiment of the stem portion of the control stick of FIG. 1.

FIG. 8 illustrates an alternative embodiment of the stem portion 56 fixed to rod 42 of the control stick 40. The alternative embodiment of the stem portion 56 increases the level of skill required by the user to manipulate the control wheel 20 using the control stick 40. The stem portion 56 comprises a pair of opposed, inwardly extending fingers 58. The fingers 58 of stem portion 56, however, preferably have a smaller diameter than the fingers 48 of stem portion 46 and taper to a necked-down portion 54 adjacent the end of the finger. The stem portion 56 further comprises an arcuate portion 57 extending between and connecting the opposed fingers 58. The arcuate portion 57 of stem portion 56, however, is longer than the arcuate portion 47 of stem portion 46 so that the opening defined by the fingers 58 is wider than necessary to receive the wheel 20 therein.

In a preferred method of manipulating the wheel 20 using the control stick 40 comprising stem portion 56, the necked-down portion 54 of one of the opposed fingers 58 is positioned within the opening 30 defined by the hollow axle 22 of the wheel so that the exterior surface 59 of the necked-down portion of the one finger engages the interior surface of the axle 22 adjacent the opening. The other of the opposed fingers 58 of the stem portion 56 of the control stick 40 may be positioned against the exterior surface 32 of the wheel 20, or (as shown) may be positioned within the recess 28 defined by the axle 22, the side wall 26 and the flange 24 of the wheel on the opposite side of the wheel.

In either position, the wheel 20 is more loosely retained between the opposed fingers 58 and the user must exhibit a greater degree of skill to accomplish the previously described preferred methods for manipulating the wheel using the control stick 40, and to maintain the wheel in an upright or tilted orientation as previously described. Preferably, the stem portion 46 may be removed and replaced with the stem portion 56 so that a user who has mastered the art of manipulating the wheel 20 using a control stick 40 comprising stem portion 46 will not become disinterested with the wheel and control stick toy 10.

It is now apparent that the invention provides a wheel and control stick toy 10 which maintains the interest of both children and adults. More particularly, the invention provides a wheel and control stick toy 10 which features an increased number of options for manipulating the wheel 20 using the control stick 40. Specifically, the wheel and control stick toy 10 includes a wheel 20 having a variety of contact surfaces (such as exterior surface 23 of axle 22, interior surface 25 of flange 24 and exterior surface 32) to be engaged by a control stick 40. The wheel and control stick toy 10 provides amusement, while simultaneously improving the cognitive and dexterity skills of both children and adults by challenging the user to devise original ways of manipulating the wheel 20 with the control stick 40. Thus, the user is unlikely to become disinterested in the toy.

The preferred embodiments of the wheel and control stick toy 10 and the methods of manipulating the wheel 20 using the control stick 40 shown and described herein are merely illustrative of the best known mode of practicing the invention and are intended to disclose only the broad principles thereof. It is expected that various modifications and many alternative embodiments of the invention can be conceived by those skilled in the art from the foregoing examples without departing from the spirit and the scope of the invention. Accordingly, the scope of the invention is intended to be limited only by the appended claims.

That which is claimed is:

1. In a wheel and control stick toy comprising a cylindrical wheel defining a transverse axis and a control stick comprising an elongate rod having opposed ends, said wheel comprising a centrally disposed, transverse axle coaxial with the transverse axis and comprising an interior surface and an exterior surface, a peripherally disposed transverse flange comprising an interior surface and an exterior surface, and a sidewall extending between and connecting said exterior surface of said axle and said interior surface of said flange so that said exterior surface of said axle, said sidewall and said interior surface of said flange define a pair of annular recesses disposed in said wheel between said axle and said flange, the elongate rod comprising a handle portion adjacent one of the opposed ends and a stem portion fixed to the other of the opposed ends, said stem portion comprising a pair of opposed fingers defining an opening therebetween and removably engageable with said wheel to manipulate said wheel on a horizontal surface, a method of manipulating the wheel and control stick toy comprising the steps of:

receiving one of said pair of opposed fingers of said stem portion of said rod within one of said pair of recesses of said wheel so that at least a portion of said one of said pair of opposed fingers engages one of said interior surface of said axle, said exterior surface of said axle, said sidewall and said interior surface of said flange;

positioning the other of said pair of opposed fingers against said exterior surface of said flange; and exerting a force on said rod so that at least one of said pair of opposed fingers manipulates said wheel on the horizontal surface.

2. In a wheel and control stick toy comprising a cylindrical wheel defining a transverse axis and a control stick comprising an elongate rod having opposed ends, the wheel comprising a centrally disposed, transverse axle coaxial with the transverse axis, said axle having a transverse opening extending therethrough and comprising an interior surface and an exterior surface, a peripherally disposed transverse flange comprising an interior surface and an exterior surface, and a sidewall extending between and connecting said exterior surface of said axle and said interior surface of said flange so that said exterior surface of said axle, said sidewall and said interior surface of said flange define a pair of annular recesses disposed in said wheel between said axle and said flange, the elongate rod comprising a handle portion adjacent one of the opposed ends and a stem portion fixed to the other of the opposed ends, said stem portion comprising a pair of opposed fingers defining an opening therebetween and removably engageable with said wheel to manipulate said wheel on a horizontal surface, a method of manipulating the wheel and control stick toy comprising the steps of:

receiving one of said pair of opposed fingers of said stem portion of said rod within the opening of said axle of said wheel;

positioning the other of said pair of opposed fingers against the exterior surface of said flange; and exerting a force on said rod so that at least one of said pair of opposed fingers manipulates said wheel on the horizontal surface.

* * * * *